US007270403B2

(12) United States Patent
Sanada

(10) Patent No.: US 7,270,403 B2
(45) Date of Patent: Sep. 18, 2007

(54) INKJET HEAD AND INKJET RECORDING APPARATUS

(75) Inventor: Kazuo Sanada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 206 days.

(21) Appl. No.: 10/929,379

(22) Filed: Aug. 31, 2004

(65) Prior Publication Data

US 2005/0046679 A1 Mar. 3, 2005

(30) Foreign Application Priority Data

Sep. 1, 2003 (JP) ..... 2003-308750

(51) Int. Cl.
*B41J 2/045* (2006.01)

(52) U.S. Cl. ..... 347/68; 347/70

(58) Field of Classification Search ..... 347/68–72
See application file for complete search history.

(56) References Cited

U.S. PATENT DOCUMENTS

| | | | | |
|---|---|---|---|---|
| 4,703,333 | A * | 10/1987 | Hubbard | 347/40 |
| 5,933,168 | A * | 8/1999 | Sakai | 347/70 |
| 2002/0140781 | A1 | 10/2002 | Dante | |
| 2002/0186278 | A1 | 12/2002 | Nakamura et al. | |

FOREIGN PATENT DOCUMENTS

| | | | |
|---|---|---|---|
| EP | 0 354 706 | A2 | 2/1990 |
| EP | 1 046 506 | A1 | 10/2000 |
| EP | 1 116 588 | A1 | 7/2001 |
| JP | 59-48839 | U | 3/1984 |
| JP | 61032762 | A | 2/1986 |
| JP | 5-177832 | A | 7/1993 |
| JP | 5-212860 | A | 8/1993 |
| JP | 2000-158645 | A | 6/2000 |
| JP | 2000-289201 | A | 10/2000 |
| JP | 2001-301179 | * | 10/2001 |
| JP | 2003-39673 | A | 2/2003 |

* cited by examiner

*Primary Examiner*—Stephen Meier
*Assistant Examiner*—Geoffrey S. Mruk
(74) *Attorney, Agent, or Firm*—Birch, Stewart, Kolasch & Birch, LLP

(57) ABSTRACT

The inkjet head comprises: a nozzle plate on which a nozzle for discharging ink droplets is formed, a portion of the nozzle plate constituting a portion of a pressure chamber for accommodating ink to be discharged through the nozzle; a piezoelectric element which applies pressure to the ink inside the pressure chamber, the piezoelectric element being attached to the nozzle plate on an ink discharge side; and a nozzle plate support member which is in contact with the nozzle plate on a side opposite from the ink discharge side and supports the nozzle plate, the nozzle plate support member having a structure in which the nozzle plate support member restrains displacement of a portion of the nozzle plate in vicinity of the nozzle caused by the piezoelectric element, and does not interfere with displacement of the portion of the nozzle plate constituting the portion of the pressure chamber other than the portion in vicinity of the nozzle caused by the piezoelectric element.

22 Claims, 13 Drawing Sheets

INKJET HEAD AND INKJET RECORDING APPARATUS

This Non-provisional application claims priority under 35 U.S.C. § 119(a) on Patent Application No(s). 2003-308750 filed in Japan on Sep. 1, 2003, the entire contents of which are hereby incorporated by reference.

BACKGROUND OF THE INVENTION

1. Field of the Invention

The present invention relates to an inkjet head and an inkjet recording apparatus, and more particularly to a technology for discharging ink through a nozzle driven with a piezoelectric element.

2. Description of the Related Art

In recent years, inkjet recording apparatuses (inkjet printers) serving as recording apparatuses that print-record images captured by digital still cameras or the like have become widely distributed. The inkjet recording apparatus is advantageous in that it is relatively inexpensive, simple to handle, and allows good quality images to be obtained. The inkjet recording apparatus has a plurality of recording elements in a recording head. The recording head is moved in a scanning direction while ink droplets are discharged from the recording elements to the recording medium such as recording paper, the recording medium is conveyed by one line when one line of image has been recorded on the recording medium, and an image is formed on the recording medium by repeating these steps.

There are inkjet printers that use a short serial head and record while causing the head to move in the width direction of the recording medium, or those that use a line head in which recording elements are arranged along a length corresponding to an entire width of the recording medium. In printers in which the line head is used, images can be recorded on the entire surface of the recording medium by scanning the recording medium in the direction perpendicular to the array direction of the recording elements. In printers in which the line head is used, a carriage or another conveyance system for moving the short head is unnecessary, and complex scanning control for the carriage movement and recording medium is not required. Moreover, the recording medium alone moves, so that recording speed can be increased in comparison with printers in which the serial head is used.

An example of a conventional print head is shown in FIG. 14. FIG. 14 is a cross-sectional view (corresponding to a cross-sectional view along line 4-4 in FIG. 3A) showing a three-dimensional configuration of an ink chamber portion inside the print head. Each nozzle 51 is provided with a pressure chamber 52. The pressure chamber 52 is substantially a square in a plane shape, and the nozzle 51 and a supply port 54 are provided to both corners on a diagonal line of the square. Each pressure chamber 52 is connected to a common flow channel 55 through each supply port 54.

An actuator 58 having a discrete electrode 57 is attached to a diaphragm 56 that constitutes the ceiling of the pressure chamber 52. The actuator 58 is deformed by application of drive voltage to the discrete electrode 57, so that the ink is discharged from the nozzle 51. When the ink is discharged, new ink is supplied to the pressure chamber 52 from the common flow channel 55 through the supply port 54. When a piezoelectric element is used as the actuator 58, the amount of ink droplets discharged can be controlled by a piezoelectric element drive signal (command signal), and the print speed can be increased by raising the drive signal frequency.

Japanese Patent Application Publication No. 5-212860 discloses an inkjet head, comprising: a pressure chamber formation portion having a nozzle substrate in which nozzle orifices are formed; a first substrate on which a reservoir and a pressure chamber are formed; an elastic plate on which an ink connection port for connecting to the reservoir is formed; a piezoelectric element disposed so as to be conjoined with the elastic plate wherein one end is fixed to an anchor block and the other end is provided as a free end; and a head frame for freely positioning the piezoelectric element via the anchor block and connecting the piezoelectric element with the pressure chamber formation portion on the upper face, wherein the inkjet head has a supply hole for feeding ink to the reservoir, and wherein the supply hole passes completely through the head frame in the direction that is parallel to the longitudinal direction of the piezoelectric element, whereby the piezoelectric element can apply longitudinal vibration to the pressure chamber. Thus, ink can be reasonably fed without wasting space in the width direction in a highly integrated inkjet head in which a plurality of pressure chambers are arranged at a high density, and even if bubbles have penetrated the ink supply holes, which are through holes, these bubbles can be easily removed.

However, in the inkjet recording apparatuses, the viscosity of the ink contained in the inkjet head changes depending on the environmental temperature, the service (resting) time, and other service environment factors. Hence, the inkjet head has to be able to discharge inks with various viscosities from low viscosity to high viscosity in order to maintain print quality. High viscosity ink is commonly difficult to discharge, and even if discharge is successful, its responsiveness is poor in comparison with low viscosity ink, and it becomes impossible to increase the operating frequency.

In the conventional example shown in FIG. 14, the nozzle (orifice) and the piezoelectric element face each other with the pressure chamber disposed therebetween. In such a structure, there is no option but to dispose the common flow channel in the space between the nozzle and the pressure chamber, and the distance between the nozzle and the piezoelectric element increases. Therefore, pressure applied by the piezoelectric element may not be transmitted to the nozzle position, and ink droplets with high viscosity might not be discharged. Nevertheless, this structure is required for separating the functions of the nozzle member and the piezoelectric element member.

Japanese Patent Application Publication No. 5-212860 does not disclose nor suggest the relationship between the pressure chamber formation portion and the discharge of ink droplets.

SUMMARY OF THE INVENTION

The present invention has been implemented taking into account the above described circumstances, and an object thereof is to provide an inkjet head and an inkjet recording apparatus which make it possible to stably discharge even high viscosity ink.

In order to attain the above described object, the present invention is directed to an inkjet head, comprising: a nozzle plate on which a nozzle for discharging ink droplets is formed, a portion of the nozzle plate constituting a portion of a pressure chamber for accommodating ink to be discharged through the nozzle; a piezoelectric element which applies pressure to the ink inside the pressure chamber, the piezoelectric element being attached to the nozzle plate on an ink discharge side; and a nozzle plate support member which is in contact with the nozzle plate on a side opposite from the ink discharge side and supports the nozzle plate, the nozzle plate support member having a structure in which the nozzle plate support member restrains displacement of a portion of the nozzle plate in vicinity of the nozzle caused by the piezoelectric element, and does not interfere with displacement of the portion of the nozzle plate constituting the portion of the pressure chamber other than the portion in vicinity of the nozzle caused by the piezoelectric element.

According to the present invention, the piezoelectric element is disposed on the ink discharge side of the nozzle plate, so that there is no other member between the piezoelectric element and the nozzle plate, and pressure can be transmitted directly to the nozzle plate by the driving of the piezoelectric element. It is therefore possible to discharge high viscosity ink. The portion of the nozzle plate other than the portion in vicinity of the nozzle is supported by the nozzle plate support member, and does not deform, so that the flight direction of the ink droplets is stable.

A diaphragm may also be provided between the nozzle plate and the piezoelectric element for receiving pressure from the piezoelectric element, deforming, and applying the pressure to the pressure chamber as a result of the deformation.

The nozzle includes a discharge orifice (aperture portion) opened in the nozzle plate, and a tubular portion inside the nozzle plate.

PZT (lead zirconate titanate) may be used as the piezoelectric element, or other non-lead-based piezoelectric elements may be used.

The nozzle plate support member may have a nozzle support portion (displacement preventing portion) for supporting the area in the vicinity of the nozzle, and a piezoelectric element action portion (displacement allowing portion) in which an opening is formed for releasing support in the area of the pressure chamber (the area of the nozzle plate that covers the pressure chamber) except for the vicinity of the nozzle. Metal material, plastic material, or another plate-shaped material may be used as the nozzle plate support member.

The piezoelectric element and the nozzle are disposed in close proximity to each other, so that pressure from the piezoelectric element can be efficiently transmitted to the ink within the pressure chamber in the vicinity of the nozzle. The distance (shortest distance) between the nozzle and the piezoelectric element is preferably 100 μm or less.

In accordance with an aspect of the present invention, the nozzle plate support member comprises: a nozzle portion which has an opening provided corresponding to the nozzle; a piezoelectric element action portion which has an opening provided corresponding to the piezoelectric element; and a connecting portion which connects the nozzle portion with the piezoelectric element action portion.

According to this aspect, the displacement of the nozzle plate due to the operation of the piezoelectric element extends all the way to the vicinity of the nozzle through the connecting portion, and the nozzle on the opposite side from the piezoelectric element is supported by the nozzle plate support member and is not displaced.

A preferable aspect is one in which the shape of the opening in the nozzle portion is similar to the opening portion in the nozzle. Moreover, a preferable aspect is one in which the shape of the opening in the piezoelectric element action portion is matched with the shape of the piezoelectric element.

In accordance with another aspect of the present invention, a portion of the nozzle plate support member forms at least a portion of the pressure chamber. According to this aspect, deformation of the nozzle plate in the vicinity of the nozzle can be reliably prevented.

An aspect in which the nozzle plate support member is integrally formed with the pressure chamber may be one in which the nozzle plate support member constitutes at least the bottom surface of the pressure chamber, or in which the support member constitutes another interior surface or the ceiling of the pressure chamber. The nozzle plate support member may of course also be integrally formed with the entire ink chamber.

In accordance with another aspect of the present invention, the inkjet head further comprises a supply port which serves as the ink flow channel to the pressure chamber from a common flow channel for supplying ink delivered from an ink storing portion to each nozzle, the supply port being disposed at a position offset from the nozzle. According to this aspect, the ink flow does not stagnate and the bubble elimination characteristics are improved by offsetting the nozzle and the supply port.

The offset arrangement includes an arrangement in which the nozzle and the supply port do not have the same center axis, an arrangement in which positions of the nozzle and the supply port projected onto the same plane are different, as well as other arrangements. For example, also possible is an aspect in which the nozzle is provided to one vertex of a polygonal ink chamber, and the supply port is provided to another vertex; and an aspect in which the nozzle is disposed on one of the vertices on the longer one of the diagonals in a substantially rhombic ink chamber, and the supply port is disposed on the other.

In accordance with yet another aspect of the present invention, a length of the ink flow channel from the common flow channel to the nozzle is 500 μm or less. According to this aspect, bubble residue in the pressure chamber can be prevented and the refilling characteristics can be ensured by shortening the distance of the ink flow channel from the nozzle to the common flow channel.

Included in the distance of the ink flow channel from the nozzle to the common flow channel is at least the thickness of the nozzle, the length of the pressure chamber, and the length of the supply port.

In accordance with yet another aspect of the present invention, a sum of a distance between the nozzle and the pressure chamber and a length of the ink flow channel of the supply port is 100 μm or less. According to this aspect, the time required for refilling can be shortened, the piezoelectric element can be driven at high speeds, and high performance printing is made possible by keeping the distance from the nozzle face (the ink-droplet ejection face of the nozzle) to the pressure chamber, which is the conduit length of the constricted portion of the ink flow channel system, that is to say, the sum of the thickness of the nozzle plate and the length of the supply port, to 100 μm or less.

The present invention is also directed to an inkjet recording apparatus comprising the above-described inkjet head.

In accordance with the present invention, the inkjet recording apparatus is mounted with the print head, in which high viscosity ink can be discharged, residual bubbles can be prevented from forming in the pressure chamber, and adequate refill characteristics can be obtained, so that the desired print quality and maintenance properties can be ensured.

In accordance with the present invention, there is no component between the nozzle plate and the piezoelectric element, and pressure from the piezoelectric element can be transmitted directly to the nozzle. The vicinity of the nozzle is supported without being deformed and without allowing the nozzle plate support member to interfere with the application of pressure by the piezoelectric element to the ink in the pressure chamber through the nozzle plate, so that pressure produced by the piezoelectric element can be efficiently transmitted to the ink within the pressure chamber, even high viscosity ink can be discharged, and the flight direction of the ink droplets can be stabilized.

The nozzle length (the conduit length of the nozzle) is shortened, so that pressure can be applied to ink in the vicinity of the nozzle. The nozzle length (the conduit length of the nozzle) is preferably 100 μm or less.

The supply port for feeding ink to the pressure chamber through the common flow channel for feeding ink delivered from the ink storing unit to each nozzle is disposed with an offset at a different position from the position facing the nozzle of the pressure chamber ceiling surface, so that ink flow does not stagnate and bubble removal characteristics are improved.

The length of the ink flow channel from the nozzle to the piezoelectric element is shortened, so that residual bubbles can be prevented, and the desired refilling characteristics can be ensured. Preferred is an aspect in which the length of the ink flow channel from the nozzle to the common flow channel is 500 μm or less. Moreover, the length of the constricted portion of the ink flow channel is shortened, so that the piezoelectric element can be driven at high speed, and high performance printing is made possible.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
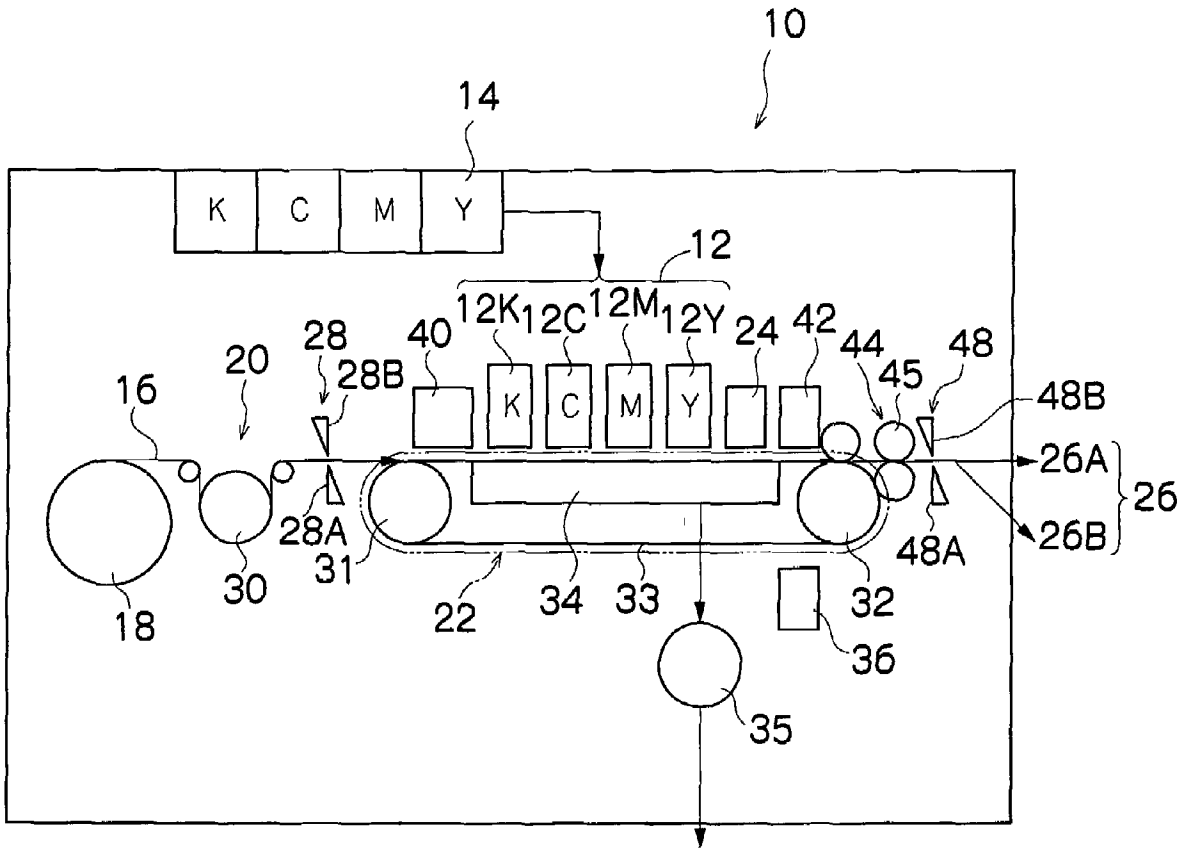
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit-26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction. The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
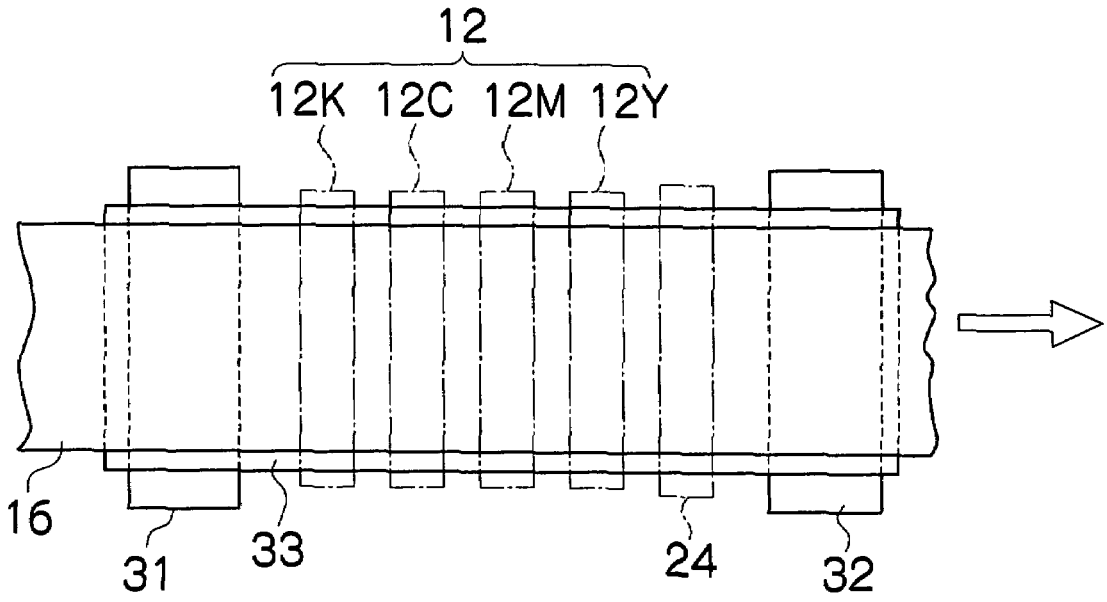
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 3A:
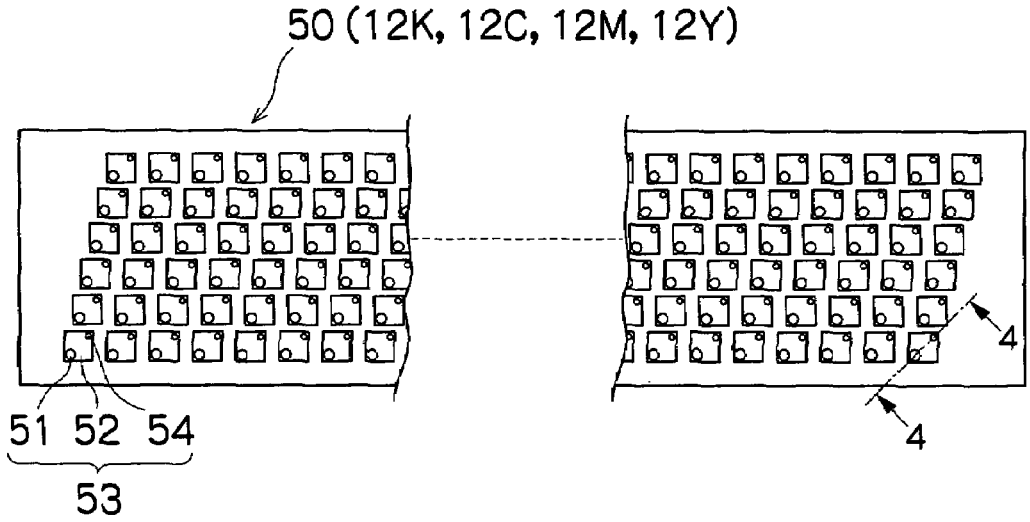
FIG. 3A is a perspective plan view showing an example of a configuration of a print head.
Figure 3B:
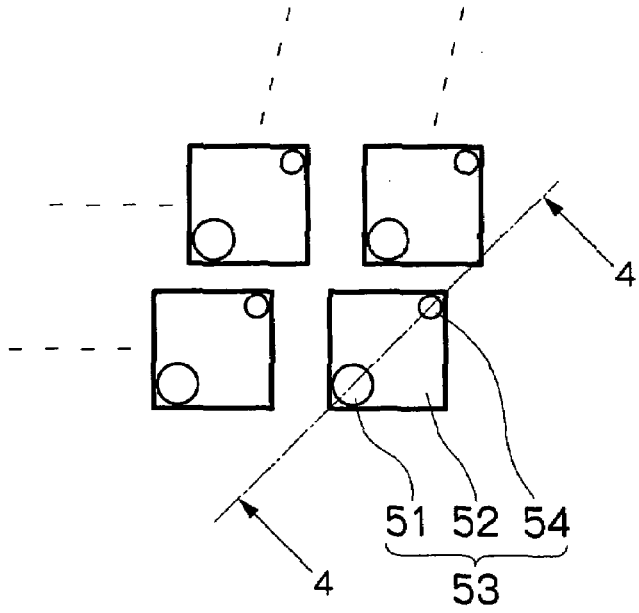
FIG. 3B is a partial enlarged view of FIG. 3A.
Figure 4:
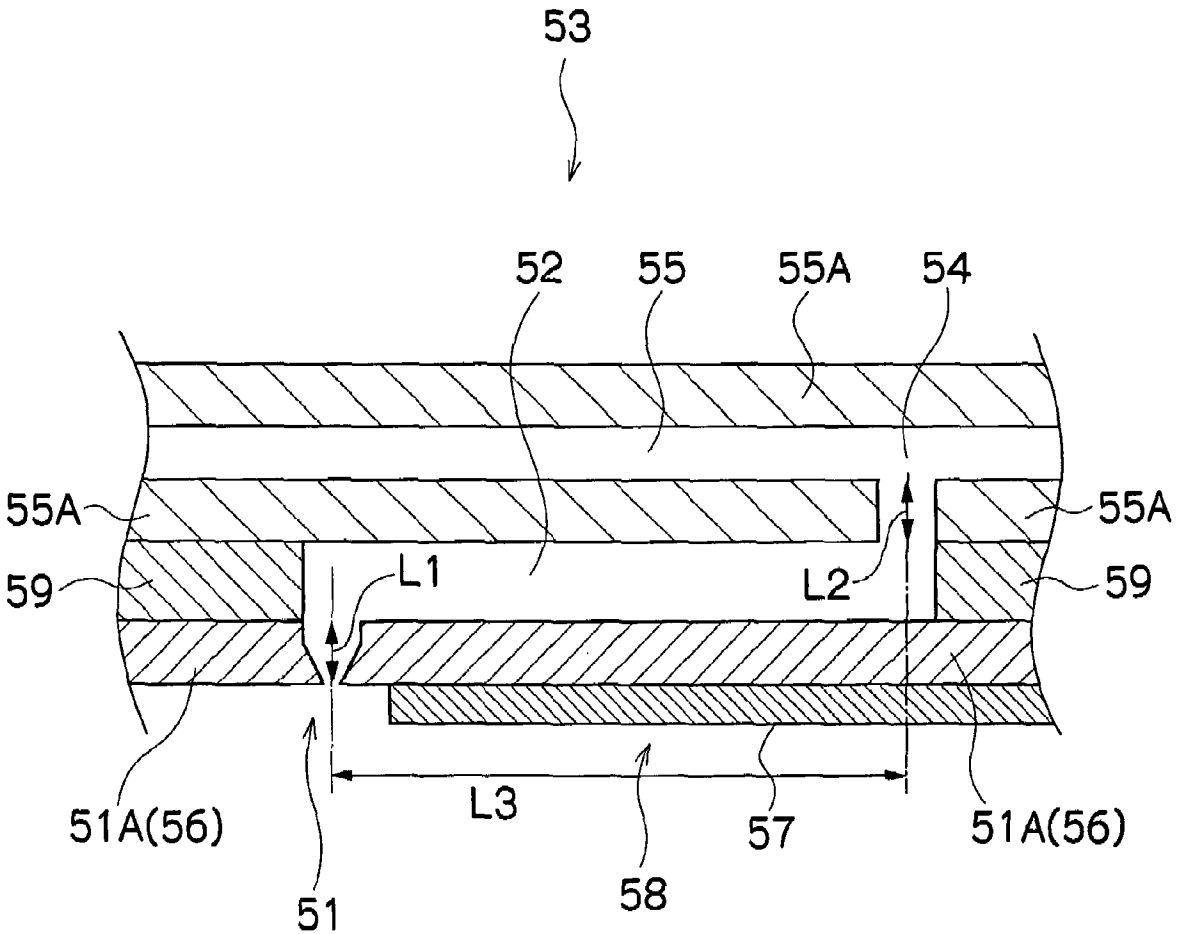
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, and FIG. 4 is a cross-sectional -view taken along the line 4-4 in FIGS. 3A and 3B, showing the inner structure of an ink chamber unit. The nozzle pitch in the print head 50 should be minimized in order to maximize the density of the dots printed on the surface of the recording paper. As shown in FIGS. 3A, 3B and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

The planar shape of the pressure chamber 52 provided for each nozzle 51 is substantially a square or a rhombus, and the nozzle 51 and supply port 54 are disposed in both corners on a diagonal line of the square or rhombus. Each pressure chamber 52 is connected to a common channel 55 through a supply port 54. The pressure chamber 52 preferably has a rhombic shape in which the straight line connecting the nozzle 51 and the supply port 54 forms the longer one of the diagonals of the rhombus, so that the flow of fluid from the supply port 54 to the nozzle 51 does not stagnate.

An actuator 58 having a discrete electrode 57 is joined to the diaphragm 56, which forms the bottom surface of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

The common flow channel 55 is formed with common flow channel plates 55A (i.e., members such as a partition member between the common flow channel 55 and the pressure chamber 52, and a member forming the wall of the common flow channel 55 opposite to the pressure chamber 52), which are composed of transparent body or semitransparent body through which rays of light can be transmitted. Hence, bubbles inside the pressure chamber 52 and the supply port 54 can be optically detected from the exterior through the common flow channel plates 55A, so that it is possible to detect non-discharge in advance and to counter such non-discharge.

In the present embodiment, the diaphragm 56 and the nozzle plate 51A forming the nozzle 51 are unified. Hereinafter, the member serving as both the nozzle plate 51A and the diaphragm 56 is referred to as the nozzle plate 51A.

A nozzle plate support member 59 is disposed between the pressure chamber 52 and the nozzle plate 51A so as to constitute at least a portion of the surrounding wall surface of the pressure chamber 52 and to be in contact with the bottom surface of the pressure chamber 52. The detailed structure of the ink chamber unit 53 shown in FIG. 4 and the details of the nozzle plate support member 59 are described later.

In FIG. 4, L1 is the conduit (flow channel) length of the nozzle 51, L2 is the conduit (flow channel) length of the supply port 54, and L3 is the flow channel length from the nozzle 51 to the supply port 54 (the length of the pressure chamber).

Figure 5:
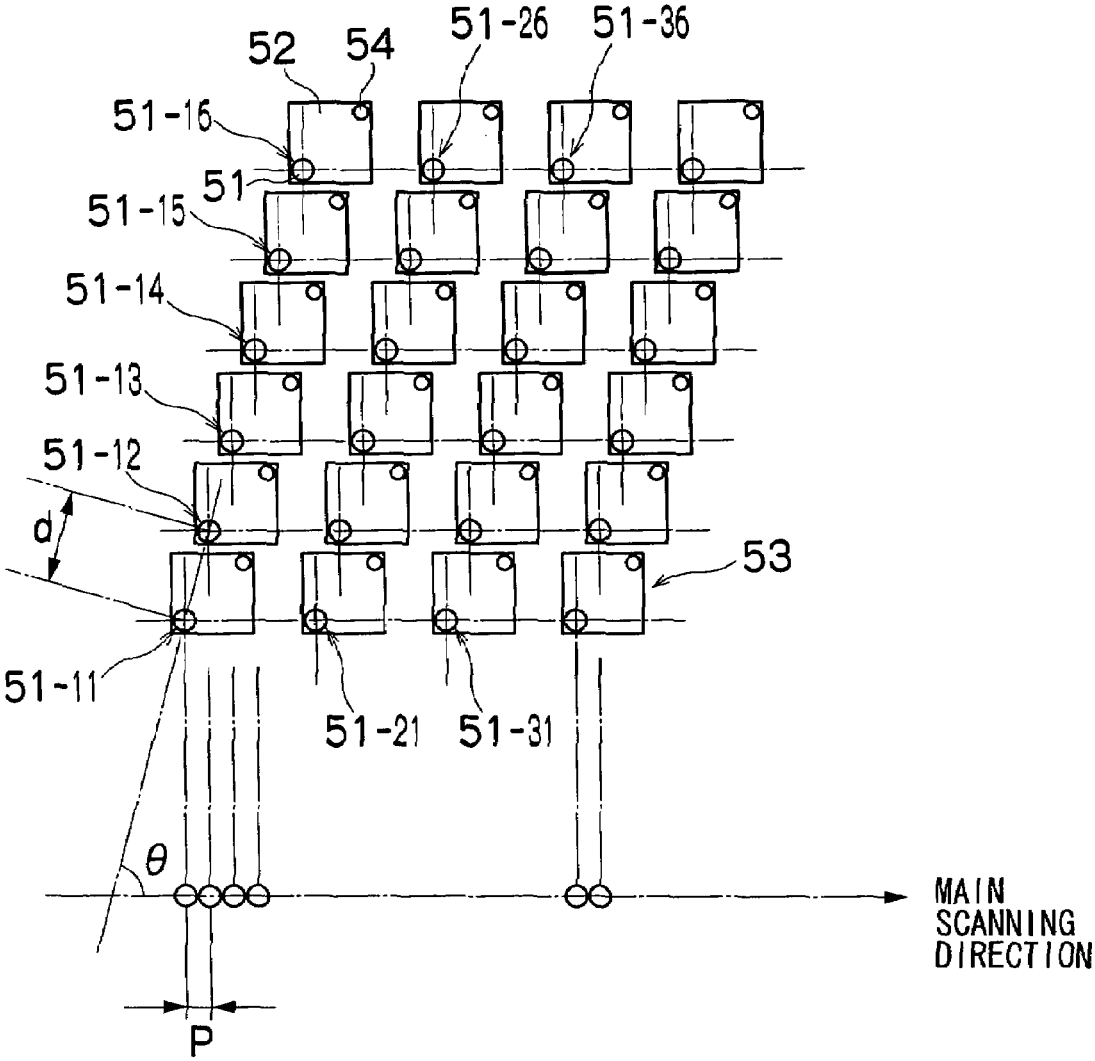
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high density of up to 2,400 nozzles per inch. For convenience in description, the structure is described below as one in which the nozzles 51 are arranged at regular intervals (pitch P) in a straight line along the lengthwise direction of the head 50, which is parallel with the main scanning direction.

In a full-line head comprising rows of nozzles that have a length corresponding to the maximum recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles

51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In the implementation of the present invention, the structure of the nozzle arrangement is not particularly limited to the examples shown in the drawings. Moreover, the present embodiment adopts the structure that ejects ink-droplets by deforming the actuator 58 such as a piezoelectric element; however, the implementation of the present invention is not particularly limited to this, and various actuators other than the piezoelectric element may be used as the actuator 58.

Figure 6:
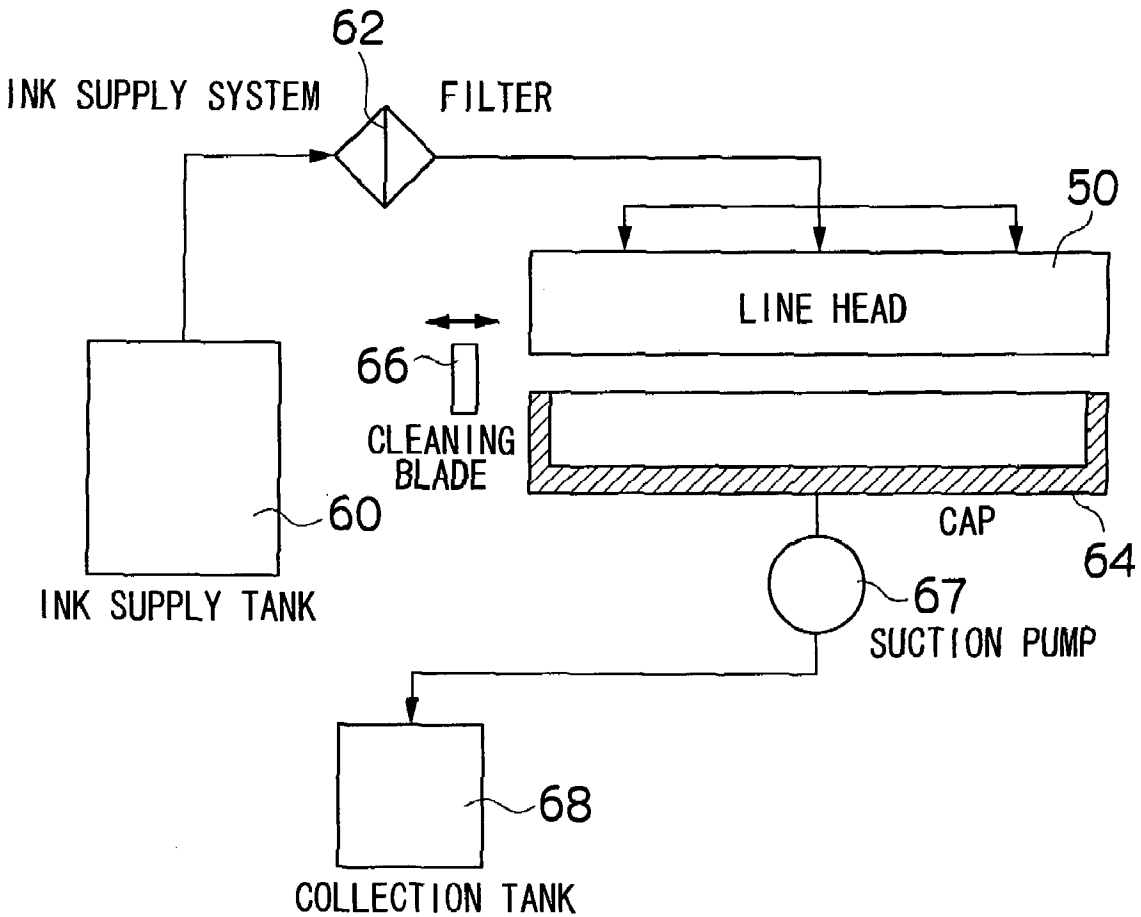
FIG. 6 is a schematic drawing showing a configuration of an ink supply system in the inkjet recording apparatus.

FIG. 6 is a schematic drawing showing the configuration of the ink supply system in the inkjet recording apparatus 10.

An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

A filter 62 for removing foreign matters and bubbles is disposed between the ink supply tank 60 and the print head 50, as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzle 51 from drying out or to prevent an increase in the ink viscosity in the vicinity of the nozzles, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

If the frequency of use of a certain nozzle 51 is low and the ink viscosity in the vicinity of the nozzle has increased while printing or during standby, a preparatory ejection is performed from the nozzle toward the cap 64 to eliminate the degraded ink.

When bubbles have become mixed into the ink (inside the pressure chamber 52) inside the print head 50, the cap 64 is placed on the print head 50, the ink (ink in which bubbles have been mixed) inside of the pressure chamber 52 is removed by suction with a suction pump 67, and the suction-removed ink is sent to a collection tank 68. This suction action is also performed when ink is initially loaded into the head, and when starting service after a long period on non-use to suction off of the degraded ink.

The cleaning blade 66 is composed of an elastic member such as rubber, and can be slid on the ink-droplet ejection surface (surface of the nozzle plate) of the print head 50 by a blade movement mechanism (not shown). When ink spray or foreign matters adhere to the nozzle plate, the nozzle plate surface is wiped and the nozzle plate surface cleaned by sliding the cleaning blade 66 on the nozzle plate.

Figure 7:
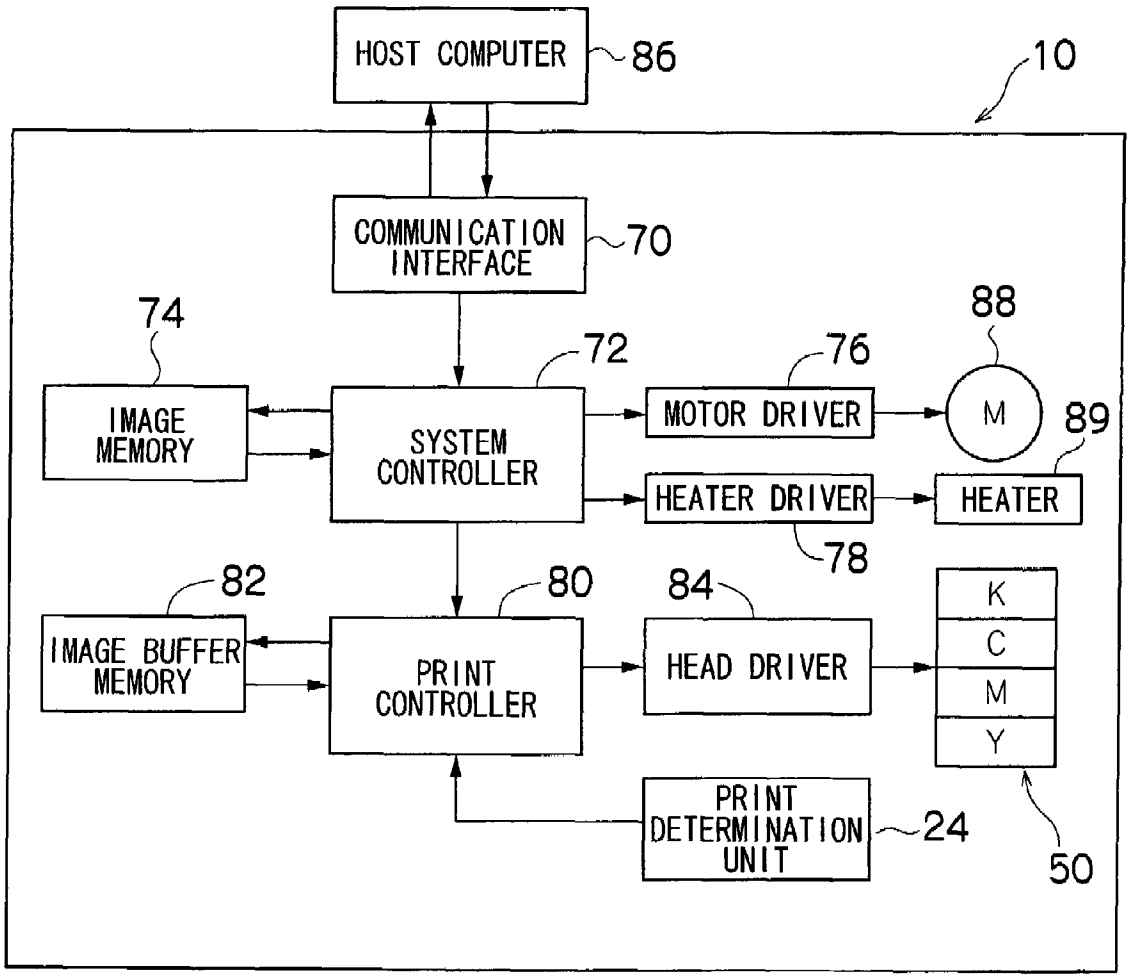
FIG. 7 is a block diagram of principal components showing a system configuration of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 8.8 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80. A feedback control system for keeping the drive conditions for the print heads constant may be included in the head driver 84.

Next, the details of the ink chamber unit 53 are described. The inkjet head according to the embodiment of the present invention is a nozzle face vibrating-type inkjet head wherein the actuator 58 directly applies pressure to the nozzle plate 51.

In the ink chamber unit 53 shown in FIG. 4, the actuator 58 is provided to the surface of the nozzle plate 51A, so that the distance between the nozzle 51 and the actuator 58 can be shortened. In such a structure, the pressure from the actuator 58 is efficiently transmitted to the ink in the vicinity of the nozzle 51, and even high viscosity ink with low fluidity can be discharged. This also naturally contributes to higher density inside the head 50.

Inside the ink chamber unit 53, there is a stacking structure formed of the nozzle 51 (nozzle plate 51A), the pressure chamber 52, the supply port 54, and the common flow channel 55 in this order. Such a configuration allows the common flow channel 55 to have wide spacing on the opposite side from the nozzle 5 1, and ink can pass through the groups of supply ports in which the arrangement of groups of nozzles is offset, and be fed to each pressure chamber 52. The common flow channel 55A can be provided with a damper structure, a support structure, a filter, and other structures.

The nozzle plate 51A on the side facing the pressure chamber 52 is fixed by the nozzle plate support member 59, which is cut away in the direction of the actuator 58, so as to restrict the movement of the nozzle 51 itself. In other words, the nozzle plate support member 59 that gives support so that the nozzle 51 is not displaced (does not deform) is provided between the nozzle plate 51A and the common flow channel plate (a member that can be a wall surface of the common flow channel 55) 55A. The nozzle plate support member 59 may constitute a portion of the wall surface of the pressure chamber 52.

It is advantageous with respect to the discharge of the high viscosity ink when the actuator 58 is attached in as close proximity as possible to the nozzle 51. When stagnated ink flow is no longer present, there is no further concern for bubble residue in the pressure chamber 52. The cutaway is hence provided to the nozzle plate support member 59.

The nozzle plate support member 59 may be a metal material, a polyimide or another plastic material, a resin material, or a material with a predetermined thickness that is capable of supporting the nozzle 51. The nozzle plate support member 59 may be formed as a structure that extends from the nozzle plate 51A to the member that forms the top surface of the pressure chamber 52. The nozzle plate support member 59 may have a multilayered structure.

Figure 8:
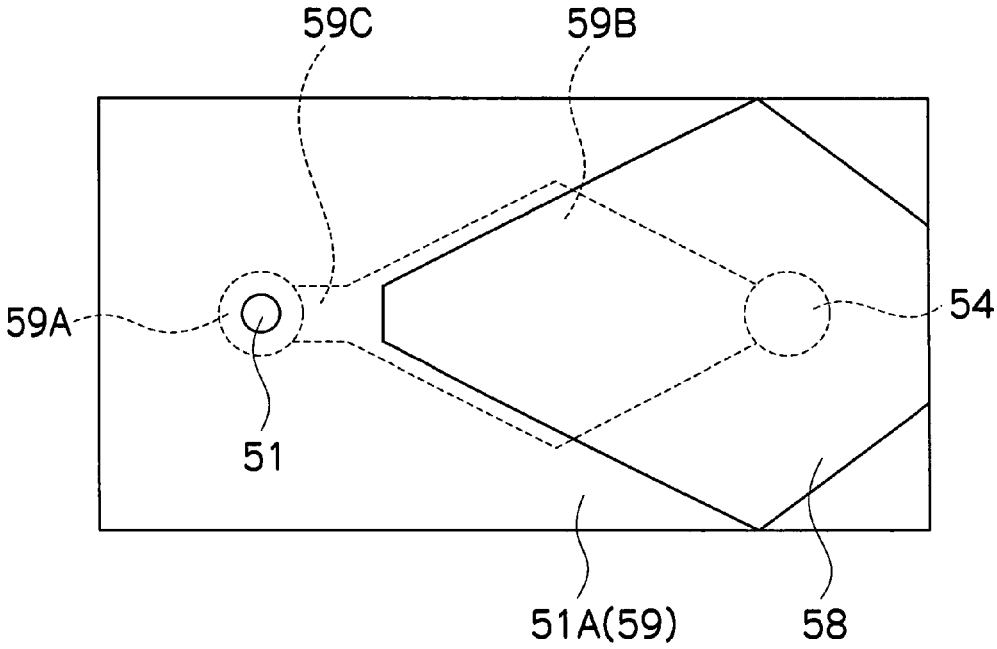
FIG. 8 is a view showing a nozzle plate support member shown in FIG. 4.

FIG. 8 shows the nozzle plate 51A, the actuator 58, and the nozzle plate support member 59 viewed from (seen through) the orifice surface of the nozzle 51.

The nozzle plate support member 59 has an opening portion 59A, which is a circular opening with substantially the same diameter as the maximum diameter of the nozzle 51, for securing the ink flow channel from the pressure chamber 52 to the nozzle 51 at a position corresponding to the nozzle 51.

The nozzle plate support member 59 has an opening portion 59B, which corresponds to the shape and arrangement of the actuator 58, and has a structure in which the displacement of the actuator 58 (the nozzle plate 51A) is directly transmitted to the ink within the pressure chamber 52 through the opening portion 59B. The opening portions 59A and 59B are connected to each other through a cutaway portion 59C.

An example of the opening portion 59B with a substantially rhombic shape is shown in FIG. 8, but the shape of the opening portion 59B is not limited to this, and quadrilateral shapes other than a rhombus and oval (oblong) shapes are also possible.

In the pressure chamber 52 shown in FIG. 4, it is preferable that the shape (shape of the bottom surface) of the pressure chamber 52 is substantially rhombic (or parallelogrammatic), the nozzle 51 is disposed at one of the vertices on the longer one of the diagonals of the rhombus, and the supply port 54 is disposed on the other vertex on the longer one of the diagonals, so that the flow of ink within the pressure chamber 52 does not stagnate any longer, and bubbles can be removed more efficiently. Furthermore, the same effect can be obtained even in a rectangular or square shaped pressure chamber 52 having a width that is substantially equal to the diameter of the nozzle, as shown in FIG. 9.

Figure 9:
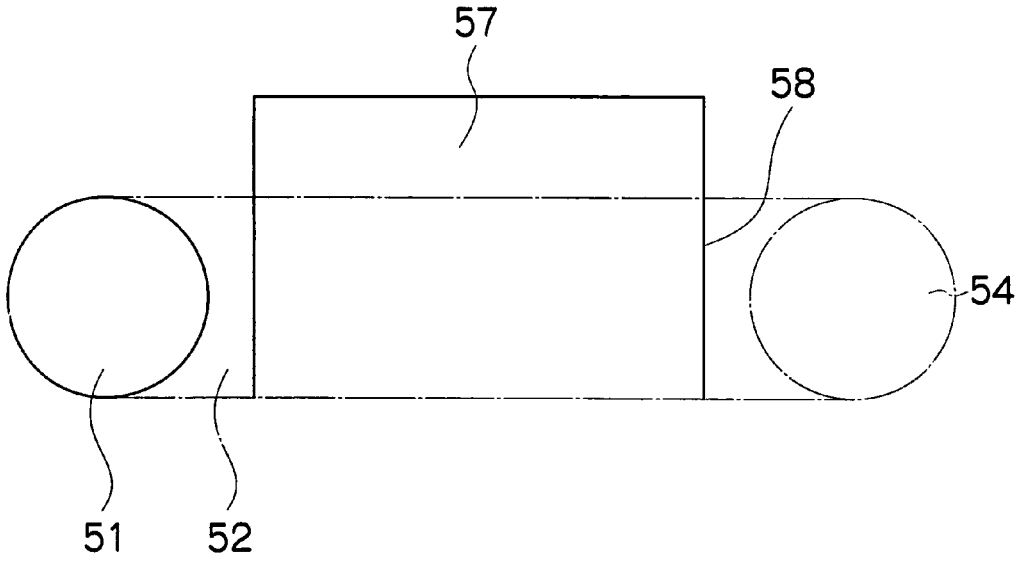
FIG. 9 is a view showing a modification of the pressure chamber shown in FIG. 8.

Although a hexagonal shaped member is exemplified as the actuator 58 in FIG. 8, the actuator 58 may have a substantially rectangular shape (or square shape), as shown in FIG. 9, that matches the shape of the pressure chamber 52 so as to cover the bottom surface portion of the pressure chamber 52 of the nozzle 51A to the extent possible. The discrete electrode 57 is preferably disposed on a fixed portion away from the bottom surface portion with which the pressure chamber 52 and the actuator 58 are in contact, as shown in FIG. 9.

Figure 10:
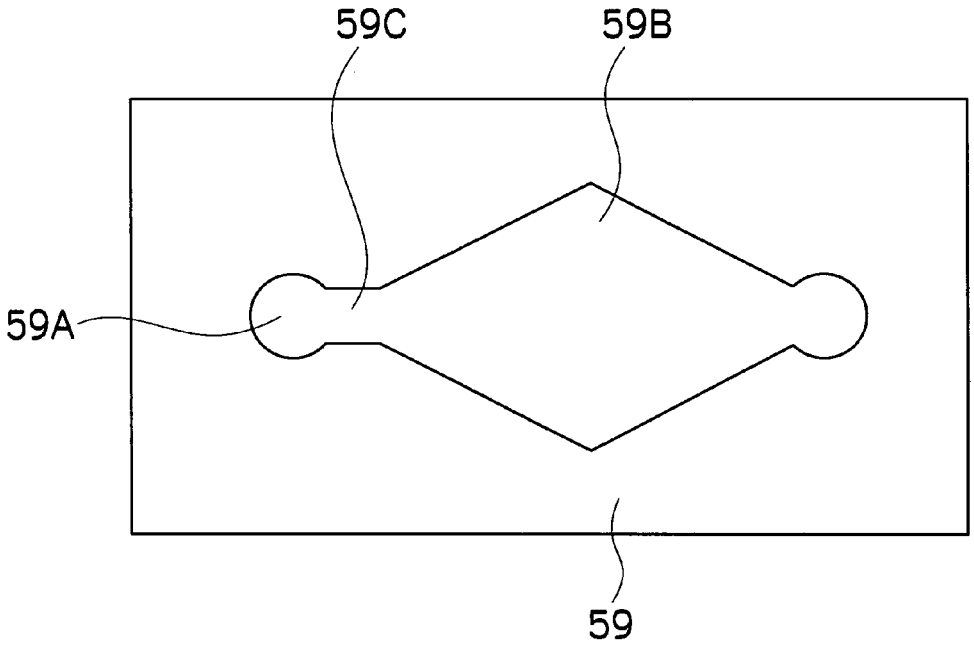
FIG. 10 is a schematic plan view of the nozzle plate support member shown in FIG. 4.

FIG. 10 is a schematic plan view in which the nozzle plate support member 59 is viewed from (seen through) the orifice face of the nozzle 51. The nozzle plate support member 59 has the opening portion 59A formed in the portion corresponding to the nozzle 51, and the opening portion 59B formed in the portion corresponding to the actuator 58, as also shown in FIG. 8. Furthermore, in order to transmit the pressure applied by the actuator 58 to the ink in the vicinity of the nozzle 51, the cutaway portion 59C is disposed so as to connect the opening portions 59A and 59B to each other. Therefore, the nozzle plate 51A is fixed by the nozzle plate support member 59 that is cut away in the direction of the actuator 58 so as to restrict the movement of the nozzle itself.

In other words, the pressure chamber 52 side of the nozzle 51 is not supported by the cutaway portion 59C, and the side that is opposite from the pressure chamber 52 of the nozzle 51 is supported by the nozzle plate support member 59. The shape of the cutaway portion 59C is not similar to the nozzle 51, as shown in FIG. 10.

In the present embodiment, an example of a full line-type line head is described; however, the applicable scope of the present invention is not limited to this, and application may be made to a shuttle-scan type serial head.

Next, the distance between the nozzle 51 and the actuator 58, and the separate flow channel length from the nozzle 51 to the common flow channel 55, are described.

By shortening the distance between the nozzle 51 and the actuator 58, not only does it become possible to discharge high viscosity ink, but also the time required for refilling is reduced, and it becomes possible to increase the drive frequency of the actuator 58. That is to say, even if higher viscosity ink is used, the drive frequency of the actuator 58 can be increased, and the print speed does not need to be reduced.

By shortening the separate flow channel length, which is the distance from the common flow channel 55 to the nozzle 51, the probability of bubble adhesion can be reduced, loss of pressure due to bubbles is thereby eliminated, and the frequency of head maintenance can be reduced. In a print head 50 in which ink chamber units 53 are arranged in the form of a matrix, a preferable aspect is one in which a connection is made directly to the separate flow channel rather than passing through branches from the common flow channel 55, in order to shorten the separate flow channel of each nozzle.

For example, if the conduit length L1 of the nozzle 51 (i.e., the thickness of the nozzle plate 51A) is 30 μm, the conduit length L2 of the supply port 54 is 30 μm, and the length L3 of the pressure chamber 52 is 300 μm, then the length of the separate flow channel (L1+L2+L3) is 360 μm. In these conditions, fluid with viscosity of 20 cP (centipoise: 1cP=10-$^{-3}$ Pa·s) can be discharged at a drive frequency of 20 kHz.

Figure 14:
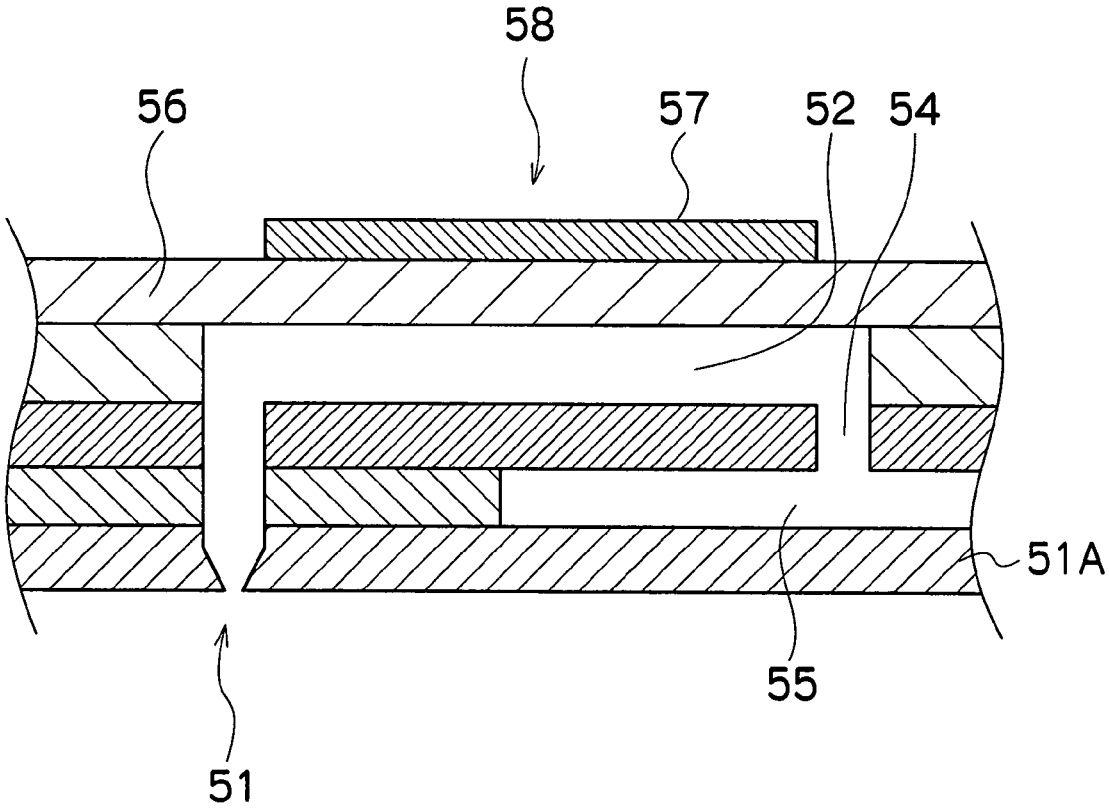
FIG.14 PRIOR ART
FIG. 14 is a view showing an example of a conventional print head.

On the other hand, in the conventional example shown in FIG. 14, the sum of the thickness of the nozzle plate 51A (=30 μm), the depth of the common flow channel 55 (=200 μm) and the conduit length of the supply port 54 (=30 μm) is the total flow channel length of 260 μm corresponding to the conduit length L1 of the nozzle 51 shown in FIG. 4. Moreover, if the conduit length L2 of the supply port 54 is 30 μm, and the length L3 of the pressure chamber 52 is 300 μm, then the length of the separate flow channel in FIG. 14 corresponding to L1+L2+L3 in FIG. 4 is 590 μm, and it is difficult to discharge fluid with viscosity of 20 cP at a drive frequency of 20 kHz in these conditions.

Here, to realize a frequency of 50 kHz that produces no discernable difference as a discharge frequency in high performance printing, the ink refilling frequency is preferably also 50 kHz or higher. For this reason, the conduit length of the constricted portion (the sum (L1+L2) of the conduit length (L1) of the nozzle 51 and the conduit length (L2) of the supply port 54) must be 100 μm or less.

If the minimum value of the diameter of the nozzle 51 that does not cause nozzle clogging is r, the minimum value of the ink droplet volume derived from the print quality is V, and the flight speed of ink at which the deposition error to be ignored is v, then the resonance frequency f that the pressure chamber 52 should have can be determined. The relationship between these characteristic values is expressed as follows:

$$V=(r^2\times v)/(4\times f). \quad (1)$$

Therefore, the drive frequency of the actuator 58 should be kept at a resonance frequency of f or higher.

In high quality printing that aims for V=4 p1, r=12 μm, and v=7 m/s, the resonance frequency that the pressure chamber 52 should have is 63 kHz, and it can be seen that maintaining a resonance frequency of 50 kHz or higher is desirable. However, when the characteristic values described above are changed, the resonance frequency f that the pressure chamber 52 should have must also be changed.

The following Table 1 shows the representative values of the sound frequencies determined by the volume of the pressure chamber 52 when the lengths of the pressure chamber 52 are 300 μm, 1 mm, and 2 mm, respectively.

TABLE 1

| Pressure Chamber Length | 300 μm | 1 mm | 2 mm |
|---|---|---|---|
| Sound Frequency | 150 kHz | 50 kHz | 25 kHz |

Figure 11:
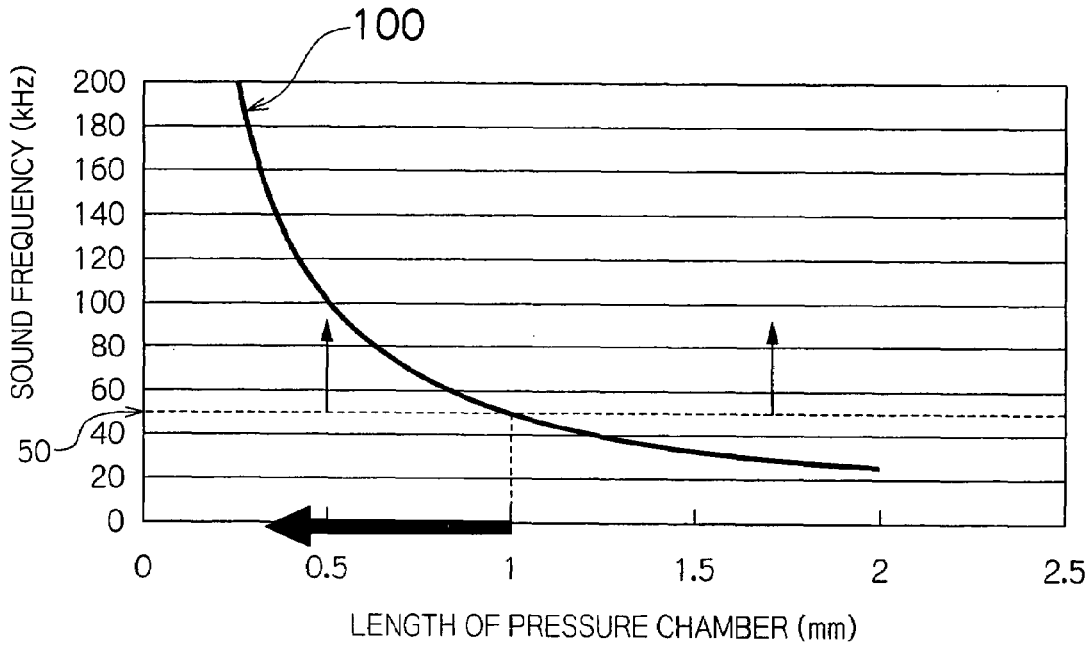
FIG. 11 is a graph showing the relationship between the length of the pressure chamber and the sound frequency.

In the graph shown in FIG. 11, the curve 100 represents the relationship between the length L3 of the pressure chamber 52 shown in FIG. 4 and the sound frequency. As seen from the curve 100 in FIG. 11, the length L3 of the pressure chamber should be 1 mm or less in order to make the sound frequency be 50 kHz or higher. Thus, if the length L3 of the pressure chamber 52 is 1 mm or less, it is simple to set the sound frequency to around 50 kHz. Also, if the cross-sectional area of the pressure chamber 52 is changed, it is possible to further change the frequency characteristics. However, the length L3 of the pressure chamber 52 is set to 300 μm or greater in order to secure the volume displaced by the driving action of the actuator 58.

The refilling frequency f1 is expressed as follows:

$$f1\propto 1/\{(\text{Compliance of the ink meniscus of the nozzle surface})\times(\text{Conduit resistance})\}. \quad (2)$$

The conduit resistance is proportional to the conduit length of the constricted portion, and the relationship between the refilling frequency f1 and the conduit length of the constricted portion is shown in the following Table 2.

TABLE 2

| Refilling Frequency | 20 kHz | 30 kHz | 40 kHz | 50 kHz |
|---|---|---|---|---|
| Conduit Length of Constricted Portion (Representative Value) | 250 μm | 167 μm | 125 μm | 100 μm |

Figure 12:
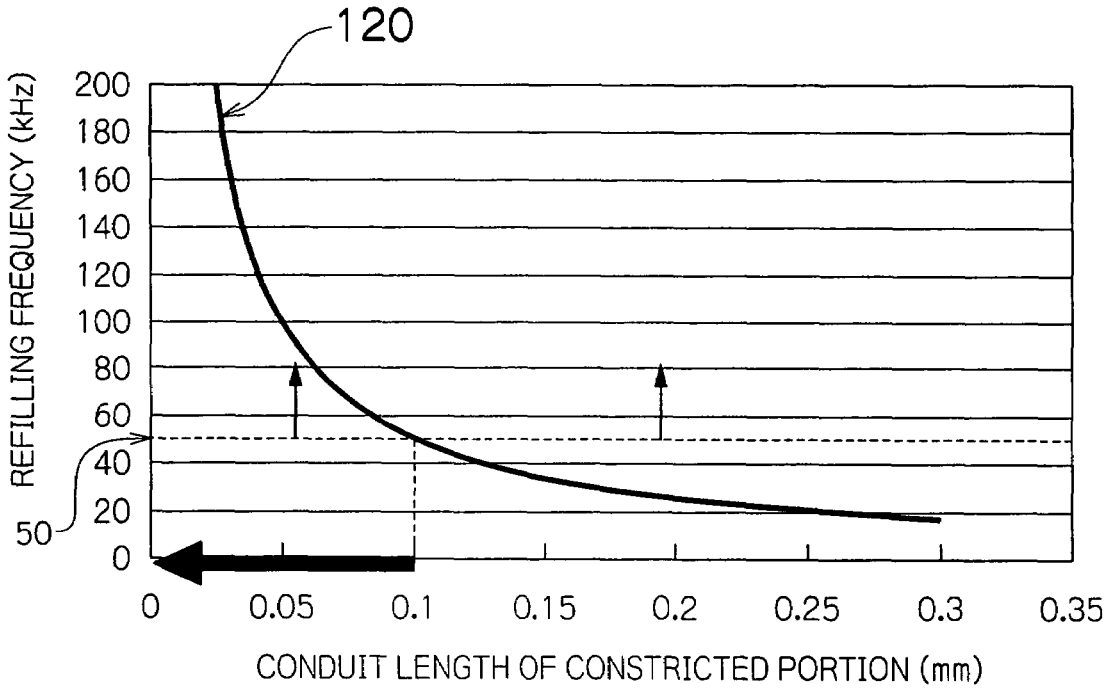
FIG. 12 is a graph showing the relationship between the conduit length of the constricted portion and the refilling frequency.

In the graph shown in FIG. 12, the curve 120 represents the relationship between the conduit length (L1+L2) of the constricted portion and the refilling frequency. As seen from the curve 120 in FIG. 12, the conduit length of the constricted portion should be 0.1 mm (100 μm) or less in order to make the refilling frequency be 50 kHz or higher.

Figure 13:
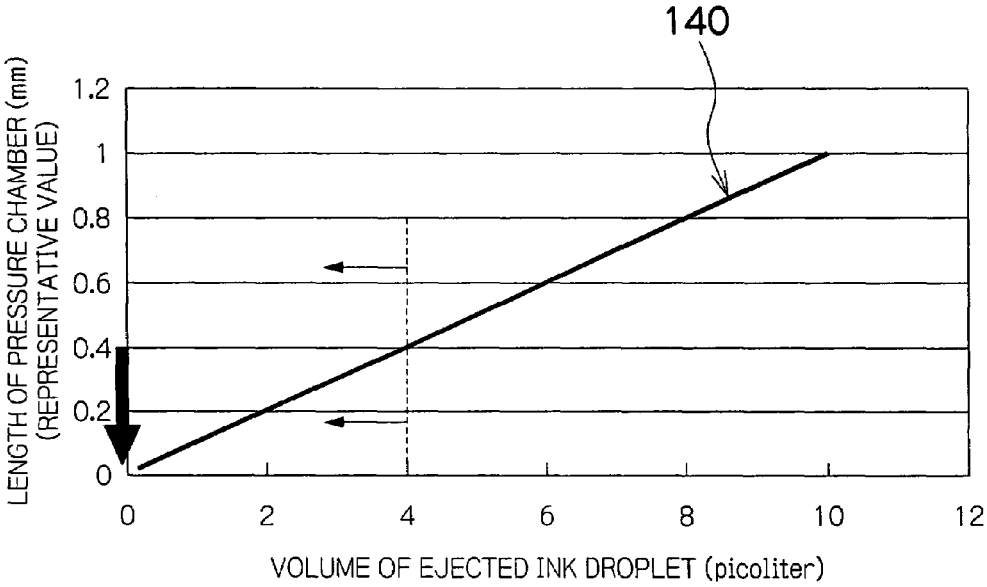
FIG. 13 is a graph showing the relationship between the volume of the ejected ink droplet and the length of the pressure chamber.

Moreover, in the graph shown in FIG. 13, the line 140 represents the relationship between the volume of the ejected ink droplet and the length of the pressure chamber (representative value). As seen from the line 140 in FIG. 13, the length L3 of the pressure chamber (shown in FIG. 4) should be 0.4 mm or less in order to make the volume of the ejected ink droplet be 4 pl or less to secure the high quality printing. Hence, it is preferable that the ink flow length between the nozzle 51 and the common flow channel 55 (L1+L2+L3 in FIG. 4) is 500 μm or less.

The refilling frequency f1 shown in Table 2 can be increased most efficiently for the system by selecting a value of about 50 kHz, which is the discharge frequency for high performance printing, so that the conduit length of the constricted portion is preferably 100 μm or less.

The refilling frequency f1 is proportional to the conduit resistance obtained from the distance (the conduit length) from the nozzle 51 to the pressure chamber 52, and the distance (the conduit length) from the common flow channel 55 to the pressure chamber 52. In the conventional head shown in FIG. 14, the distance from the nozzle 51 to the pressure chamber 52 is 200 μm or greater, the distance from the common flow channel 55 to the pressure chamber 52 is 50 μm or greater, a refilling frequency of 20 kHz is then obtained when the conduit length of the constricted portion is 250 μm determined from Table 2, and higher speeds (the refilling frequency of 50 kHz) cannot be realized.

On the other hand, in the print head according to the embodiment of the present invention shown in FIG. 4, the distance from the nozzle 51 to the common flow channel 55 is a length (L1+L2+L3) obtained by totaling the thickness of the nozzle plate 51A (i.e., the conduit length L1 of the nozzle 51), the thickness of the common flow channel plate 55A separating the pressure chamber 52 and the common flow channel 55 (i.e., the conduit length L2 of the supply port 54), and the length (L3) of the pressure chamber 52. Here, if the conduit length L1 of the nozzle 51 is 50 μm or greater, the conduit length L2 of the supply port 54 is 50 μm, and the length L3 of the pressure chamber 52 is 300 μm or greater, then a flow channel length of 500 μm from the nozzle 51 to the common flow channel 55 can be realized.

The embodiment of the present invention thus fulfills the condition that "the length of the separate flow channel from the nozzle 51 to the common flow channel 55 be 500 μm or less, or that the distance between the nozzle 51 and the pressure chamber 52 (distance between the nozzle 51 and the actuator 58) be 100 μm or less", and a high speed system can be realized.

In the inkjet recording apparatus 10 configured as described above, the actuator 58 is provided to the face on which the nozzle 51 is formed, and the actuator 58 and nozzle 51 are arranged in the ink chamber unit 53 in close proximity to each other without being placed between other members, so that the distance between the actuator 58 and the nozzle 51 can be reduced.

The actuator 58 and nozzle 51 are formed in close proximity to each other on the nozzle plate 51A, on which the nozzle 51 is formed, and the actuator 58 and nozzle 51 are arranged in the pressure chamber 52 in close proximity to each other without being placed between other members. Thus, the drive point of the actuator 58 and the ink discharge (separation) point can be arranged close to each other, and even ink with low fluidity can be discharged. This also contributes to higher density inside the print head 50.

Moreover, the nozzle 51 is supported by the nozzle plate support member 59 that is cut away in the direction of the actuator 58 so as to restrict the movement of the nozzle 51 itself, so that the nozzle 51 is fixed in a configuration that does not negatively affect the transmission of pressure, and the discharge direction of the ink can be made stable.

Furthermore, the distance from the pressure chamber 52 to the nozzle 51 is preferably 100 μm or less, and the length of the separate flow channel, which is the distance from the common flow channel 55 to the forefront of the nozzle 51, is preferably 500 μm or less, so that the actuator 58 can be driven at high speeds even when high viscosity ink is used. When the length of the separate flow channel is reduced, it is less likely that bubbles will adhere in the separate flow channel, and the loss of pressure due to bubbles can be held in check, so that the actuator 58 can be driven at high speeds.

The nozzle 51 and the supply port 54 are disposed above and below the positions facing to each other inside the pressure chamber 52, so that the flow of ink in the pressure chamber 52 does not stagnate any longer, and bubble can be removed more efficiently.

A configuration is provided in which wide spacing for the common flow channel 55 can be secured on the opposite side from the nozzle plate 51A of the pressure chamber 52, and ink is supplied to each pressure chamber 52 through groups of supply ports that are offset from the arrangement of the groups of nozzles, so that separate ink flow channels from the common flow channel 55 to the pressure chambers 52 can be dispensed with, and high viscosity fluid (a fluid of viscosity higher than the fluid commonly used) can be supplied in a smooth manner with the supply port 54 alone.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet head, comprising:

a nozzle plate on which a nozzle for discharging ink droplets is formed, a portion of the nozzle plate constituting a portion of a pressure chamber for accommodating ink to be discharged through the nozzle;

a piezoelectric element which applies pressure to the ink inside the pressure chamber, the piezoelectric element being attached to the nozzle plate on an ink discharge side;

a nozzle plate support member which is in contact with the nozzle plate on a side opposite from the ink discharge side and supports the nozzle plate, the nozzle plate support member having a structure in which the nozzle plate support member restrains displacement of a portion of the nozzle plate in vicinity of the nozzle caused by the piezoelectric element, and does not interfere with displacement of the portion of the nozzle plate constituting the portion of the pressure chamber other than the portion in vicinity of the nozzle caused by the piezoelectric element; and a supply port which serves as an ink flow channel to the pressure chamber from a common flow channel for supplying ink delivered from an ink storing portion to the nozzle, the supply port being disposed at a position offset from the nozzle, wherein a length of the ink flow channel from the common flow channel to the nozzle is 500 μm or less.

2. The inkjet head as defined in claim 1, wherein a sum of a distance between the nozzle and the pressure chamber and the length of the ink flow channel of the supply port is 100 μm or less.

3. An inkjet recording apparatus comprising the inkjet head as defined in claim 2.

4. The inkjet head as defined in claim 1, wherein the nozzle plate support member comprises:

a nozzle portion which has an opening provided corresponding to the nozzle;

a piezoelectric element action portion which has an opening provided corresponding to the piezoelectric element; and a connecting portion which connects the nozzle portion with the piezoelectric element action portion.

5. The inkjet head as defined in claim 4, further comprising a supply port which serves as an ink flow channel to the pressure chamber from a common flow channel for supplying ink delivered from an ink storing portion to each nozzle, the supply port being disposed at a position offset from the nozzle.

6. An inkjet recording apparatus comprising the inkjet head as defined in claim 5.

7. An inkjet recording apparatus comprising the inkjet head as defined in claim 4.

8. The inkjet head as defined in claim 1, wherein a portion of the nozzle plate support member forms at least a portion of the pressure chamber.

9. An inkjet recording apparatus comprising the inkjet head as defined in claim 8.

10. An inkjet recording apparatus comprising the inkjet head as defined in claim 1.

11. The inkjet head as defined in claim 1, wherein ink discharge side of the nozzle plate is a side opposite to the pressure chamber.

12. The inkjet head as defined in claim 1, wherein the piezoelectric element and the pressure chamber are on opposite sides of the nozzle plate.

13. The inkjet head as defined in claim 1, wherein the nozzle plate support member includes:

a nozzle portion which has a first opening corresponding to the nozzle;

a piezoelectric element action portion which has a second opening corresponding to the piezoelectric element; and a connecting portion which connects the first opening with the second opening and has a width smaller than the first opening.

14. The inkjet head as defined in claim 13, wherein:

the first opening includes a circular opening having a substantially same diameter as a maximum diameter of the nozzle; and the second opening includes an opening having a substantially same shape as the piezoelectric element.

15. An inkjet head, comprising:

a nozzle plate on which a nozzle for discharging ink droplets is formed, a portion of the nozzle plate constituting a portion of a pressure chamber for accommodating ink to be discharged through the nozzle;

a piezoelectric element which applies pressure to the ink inside the pressure chamber, the piezoelectric element being attached to the nozzle plate on an ink discharge side;

a nozzle plate support member which is in contact with the nozzle plate on a side opposite from the ink discharge side and supports the nozzle plate, the nozzle plate support member having a structure in which the nozzle plate support member restrains displacement of a portion of the nozzle plate in vicinity of the nozzle caused by the piezoelectric element, and does not interfere with displacement of the portion of the nozzle plate constituting the portion of the pressure chamber other than the portion in vicinity of the nozzle caused by the piezoelectric element, wherein the nozzle plate support member comprises:

a nozzle portion which has an opening provided corresponding to the nozzle;

a piezoelectric element action portion which has an opening provided corresponding to the piezoelectric element; and a connecting portion which connects the nozzle portion with the piezoelectric element action portion;

wherein the inkjet head further comprises:

a supply port which serves as an ink flow channel to the pressure chamber from a common flow channel for supplying ink delivered from an ink storing portion to each nozzle, the supply port being disposed at a position offset from the nozzle, wherein a length of the ink flow channel from the common flow channel to the nozzle is 500 μm or less.

16. The inkjet head as defined in claim 15, wherein a sum of a distance between the nozzle and the pressure chamber and a length of the ink flow channel of the supply port is 100 μm or less.

17. An inkjet recording apparatus comprising the inkjet head as defined in claim 16.

18. An inkjet recording apparatus comprising the inkjet head as defined in claim 15.

19. An inkjet head, comprising:

a nozzle plate on which a nozzle for discharging ink droplets is formed, a portion of the nozzle plate constituting a portion of a pressure chamber for accommodating ink to be discharged through the nozzle;

a piezoelectric element which applies pressure to the ink inside the pressure chamber, the piezoelectric element being attached to the nozzle plate on an ink discharge side;

a nozzle plate support member which is in contact with the nozzle plate on a side opposite from the ink discharge side and supports the nozzle plate, the nozzle plate support member having a structure in which the nozzle plate support member restrains displacement of a portion of the nozzle plate in vicinity of the nozzle caused by the piezoelectric element, and does not interfere with displacement of the portion of the nozzle plate constituting the portion of the pressure chamber other than the portion in vicinity of the nozzle caused by the piezoelectric element; and a supply port which serves as an ink flow channel to the pressure chamber from a common flow channel for supplying ink delivered from an ink storing portion to the nozzle, the supply port being disposed at a position offset from the nozzle, wherein the common flow is formed with a first and second common flow channel plate, the first common flow channel plate being between the common flow channel and the pressure chamber, and the second flow channel plate forming a wall opposite to the pressure chamber, wherein a length of the ink flow channel from the common flow channel to the nozzle is 500 μm or less.

20. An inkjet recording apparatus comprising the inkjet head as defined in claim 19.

21. An inkjet head, comprising:

a nozzle plate on which a nozzle for discharging ink droplets is formed, a portion of the nozzle plate constituting a portion of a pressure chamber for accommodating ink to be discharged through the nozzle;

a piezoelectric element which applies pressure to the ink inside the pressure chamber, the piezoelectric element being attached to the nozzle plate on an ink discharge side;

a nozzle plate support member which is in contact with the nozzle plate on a side opposite from the ink discharge side and supports the nozzle plate, the nozzle plate support member having a structure in which the nozzle plate support member restrains displacement of a portion of the nozzle plate in vicinity of the nozzle caused by the piezoelectric element, and does not interfere with displacement of the portion of the nozzle plate constituting the portion of the pressure chamber other than the portion in vicinity of the nozzle caused by the piezoelectric element; and a supply port which serves as an ink flow channel to the pressure chamber from a common flow channel for supplying ink delivered from an ink storing portion to the nozzle, the supply port being disposed at a position offset from the nozzle, wherein the common flow is formed with a first and second common flow channel plate, the first common flow channel plate being between the common flow channel and the pressure chamber, and the second flow channel plate forming a wall opposite to the pressure chamber, wherein a sum of a distance between the nozzle and the pressure chamber and the length of the ink flow channel of the supply port is 100 μm or less.

22. An inkjet recording apparatus comprising the inkjet head as defined in claim 21.

* * * * *